US008777639B2

(12) United States Patent
Gleissner et al.

(10) Patent No.: US 8,777,639 B2
(45) Date of Patent: Jul. 15, 2014

(54) PLUG-IN SOCKET PROVIDED WITH A VOLTAGE CONVERTER

(75) Inventors: Achim Gleissner, Barienrode (DE); Christoph Jehle, Freiburg (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 748 days.

(21) Appl. No.: 11/885,906

(22) PCT Filed: Mar. 4, 2006

(86) PCT No.: PCT/EP2006/002001
§ 371 (c)(1),
(2), (4) Date: Apr. 2, 2008

(87) PCT Pub. No.: WO2006/094728
PCT Pub. Date: Sep. 14, 2006

(65) Prior Publication Data

US 2008/0194151 A1 Aug. 14, 2008

(30) Foreign Application Priority Data

Mar. 7, 2005 (DE) ..... 10 2005 010 866

(51) Int. Cl.
*H01R 13/58* (2006.01)
*H01R 31/00* (2006.01)

(52) U.S. Cl.
USPC ..... 439/76.1; 439/651; 439/604; 439/936

(58) Field of Classification Search
USPC ..... 439/680, 76.1, 638, 604, 606, 936, 651
See application file for complete search history.

(56) References Cited

U.S. PATENT DOCUMENTS

| | | | |
|---|---|---|---|
| 3,728,586 | A | 4/1973 | Inhelder et al. |
| 4,386,333 | A | 5/1983 | Dillian |
| 4,488,201 | A | 12/1984 | Webb et al. |
| 5,297,015 | A | 3/1994 | Miyazaki et al. |
| 5,434,740 | A | 7/1995 | Chan |

(Continued)

FOREIGN PATENT DOCUMENTS

| | | |
|---|---|---|
| DE | 1 050 852 | 2/1959 |
| DE | 42 27 629 | 2/1994 |

(Continued)

OTHER PUBLICATIONS

Gerhard B. Wolski: Komplettes Netzteil in einem Chip. DE/der elektromeister + deutsches elektrohandwerk, 1990, DE 22/90, pp. 1673-1674 and 1679.

*Primary Examiner* — F O Figueroa
(74) *Attorney, Agent, or Firm* — Frommer Lawrence & Haug LLP

(57) ABSTRACT

A plug-in socket for coupling to a corresponding standard plug and for connection of an electrical terminal device to a primary voltage. The plug-in socket improves the use of mains units with voltage converters. The plug-in socket comprises a socket housing, a first electrical contact arranged in the socket housing for coupling to a corresponding standard plug electrical contact, a voltage converter integrated in the socket housing and converting a primary voltage into at least one secondary voltage for the electrical terminal device, a second electrical contact arranged on the socket housing for electrical contacting of the secondary voltage, wherein the voltage converter is integrated in the socket housing so that the external dimensions of the socket housing are substantially predetermined by the dimensions of the corresponding standard plug.

18 Claims, 5 Drawing Sheets

(56) References Cited

U.S. PATENT DOCUMENTS

| | | | | |
|---|---|---|---|---|
| 5,589,760 | A * | 12/1996 | Lee | 323/247 |
| 6,160,728 | A | 12/2000 | Peterson et al. | |
| 6,515,851 | B1 * | 2/2003 | Ootori et al. | 439/535 |
| 2001/0023153 | A1 * | 9/2001 | Mayer et al. | 439/76.1 |
| 2003/0013332 | A1 | 1/2003 | Lin | |
| 2004/0166735 | A1 | 8/2004 | Gibboney | |
| 2005/0020133 | A1 | 1/2005 | Homann et al. | |
| 2006/0019512 | A1 * | 1/2006 | Kent et al. | 439/76.1 |

FOREIGN PATENT DOCUMENTS

| | | |
|---|---|---|
| DE | 93 20 893 | 5/1995 |
| DE | 296 21 936 | 10/1997 |
| DE | 695 23 410 | 5/2002 |
| DE | 101 57 158 | 5/2003 |
| DE | 102 46 855 | 8/2004 |
| EP | 0 085 802 | 8/1983 |
| GB | 1 214 678 | 12/1970 |

* cited by examiner

FIGUR 1

FIGUR 2

PLUG-IN SOCKET PROVIDED WITH A VOLTAGE CONVERTER

CROSS-REFERENCE TO RELATED APPLICATIONS

This application claims priority of International Application No. PCT/EP2006/002001, filed Mar. 4, 2006 and German Application No. 10 2005 010 866.0, filed Mar. 7, 2005, the complete disclosures of which are hereby incorporated by reference.

BACKGROUND OF THE INVENTION a) Field of the Invention

The invention concerns mains units for voltage conversion for electronic terminal devices. The invention concerns in particular a plug-in socket for coupling to corresponding standard plugs and for connecting an electrical terminal device to a voltage supply. The invention also concerns means for voltage conversion for a plug-in socket.

b) Description of the Related Art

Voltage converters in the form of what are referred to as mains units have been known for some time. They convert a primary voltage (for example a mains voltage) into a secondary voltage. In a wide-spread form those mains units are disposed in a separate housing and connected to the mains network by means of a cable. A further cable connects the mains unit and the terminal device to be supplied.

In another wide-spread form as is known for example from laid-open EP 0 085 802 A1 the mains unit has a housing which is fixedly connected to the housing of a mains plug.

DE 93 208 93 U1 discloses a mains plug with incorporated mains unit, a so-called plug mains unit. The electronic system for converting a primary voltage into a secondary voltage is disposed with other electronic components on a circuit board.

DE 42 27 629 A1 also discloses a mains plug for the connection of electrical terminal devices. In order to dissipate the heat loss from voltage transformation away from the plug housing it is proposed that the plug pins are used for cooling purposes.

Wolski, Gerhard B: Komplettes Netzteil in einem Chip. EN: DE/Der Elektromeister+deutsches Handwerk. 1990, DE 22/90, pages 1673, 1674, 1679 describes a complete mains unit which is implemented in a single chip.

Mains units are therefore known in which the voltage converter is disposed in a separate housing outside the item of equipment to be supplied. Electrical coupling to the mains network as well as electrical coupling of the terminal device which is to be supplied are effected by means of separate electric lines.

Mains units are frequently also embodied in the form of part of the electronic device system. They are disposed for example on the same printed circuit board as the rest of the electronic components of the terminal device. Mains units are also known which are specifically suitable for use in computers. They are disposed in their own housing which in turn is incorporated into the housing of the terminal device to be supplied. Those mains units are not hermetically sealed and in addition involve artificial convection, for example they have a possible way of dissipating waste heat, for example by way of slots and their own electrical ventilation.

When using separate mains units, for example in the configuration of a plug mains unit, but also in relation to the mains units in a separate housing within a larger housing of the terminal device, considerable limitations in terms of operating comfort and convenience and a high level of complication and expenditure in terms of installation and contacting of those mains units with the mains network have to be accepted. External mains units which have cable connections on both sides also considerably restrict the level of convenience of use. A problem which frequently occurs is that the weight of the mains unit which in fact is arranged centrally in the cable pulls on the cable in such a way that either the plug connection to the terminal device comes loose or the terminal device can even be pulled down off a support and destroyed.

OBJECT AND SUMMARY OF THE INVENTION

The primary object of the invention is to improve the use of mains units with means for voltage conversion, in comparison with the state of the art.

That object is attained by a plug-in socket for coupling to corresponding standard plugs and for connection of an electrical terminal device to a primary voltage, comprising a socket housing, first electrical contact means arranged in the socket housing for coupling to corresponding electrical contact means of the standard plugs, means integrated in the socket housing for voltage conversion of a primary voltage into at least one secondary voltage for the electrical terminal device, second electrical contact means arranged on the socket housing for electrical contacting of the secondary voltage and wherein the voltage conversion means are integrated in the socket housing so that the external dimensions of the socket housing are substantially predetermined by the dimensions of the corresponding standard plug. The object is further attained by voltage conversion means for a plug-in socket as set forth above comprising a closed one-part structural form. The object is still further attained by an electrical terminal device comprising a plug-in socket as set forth above.

For that purpose the plug-in socket according to the invention has a socket housing in which first electrical contact means for coupling to corresponding electrical contact means of the standard plugs are arranged. In addition means for voltage conversion of a primary voltage into at least one secondary voltage for the electrical terminal device are integrated in the socket housing and second electrical contact means for electrical contacting of the secondary voltage are arranged on the socket housing. In that case the means for voltage conversion are integrated in the socket housing in such a way that the external dimensions of the socket housing are substantially predetermined by the dimensions of the corresponding standard plug.

Integration of the voltage conversion means into the socket housing of a plug-in socket according to the invention affords numerous advantages. Firstly, the plug-in socket according to the invention prevents the user being able to replace an external mains unit with voltage converter by another mains unit with a standard mains plug which also fits—which therefore corresponds. That exchange can have the result that the electrical specifications of the terminal device are not satisfied by the new mains unit. The consequence are faults and malfunctions of the terminal device which are generally attributed to the respective terminal device by the user. If however the voltage converter is integrated in the plug-in socket of the terminal device, a simple conventional cable connection is sufficient for connecting the terminal device to the mains voltage. The electrical specification which is generally difficult to understand from the point of view of the final consumer is thus no longer of significance. That results in a lower susceptibility to faults.

There are also advantages over conventional terminal devices with a separate mains unit disposed in the housing of the terminal device, for voltage conversion. When the above-mentioned mains voltage converters are conventionally installed in the terminal device, the entire terminal device must comply with certain approval provisions and must therefore be subjected to safety checks. That procedure is extremely expensive and in addition requires the use of specific materials within the terminal device, such as for example specific printed circuit board materials and so forth, which increase the cost of the overall product. If however the voltage conversion means are integrated into the plug-in socket in accordance with the invention, they do not represent a fixed component part of the terminal device, but a component part of the plug-in socket. The aforementioned approval provisions and safety checks are no longer relevant to the terminal device.

Preferably the plug-in socket has a mains switch which is also integrated into the socket housing for interrupting the primary circuit, wherein the external dimensions of the socket housing are substantially predetermined by the dimensions of the corresponding standard plug and the mains switch. That measure according to the invention can provide that, in addition to the above-mentioned advantages, the terminal device can be set to a genuine zero consumption. That is successfully possible only if the primary circuit is interrupted. When the secondary circuit is switched off, there is still a residual current consumption. That counteracts the problem of parasitic or unwanted stand-by current consumption which on an annual basis causes immense costs in households. With conventional mains units which are disposed outside the terminal device in the proximity of the plug, mounting a switch is at least inconvenient or even impossible. In accordance with the present invention it is now possible to interrupt the primary circuit directly at the device and nonetheless to enjoy the advantages which, in consideration of the approval provisions and safety checks, were only afforded to the devices which have an external mains unit. In particular, that also makes it possible to meet future requirements if all electrical devices are one day to be equipped with a primary mains switch. Primary mains switches on the terminal device are virtually impossible when using plug mains units.

Preferably the plug-in socket has an electronic filter which is also integrated into the socket housing, wherein the external dimensions of the socket housing are substantially predetermined by the dimensions of the corresponding standard plug, and the space required for the electronic filter. It is an essential concept of the present invention that the respective electronics in the plug-in socket are given only precisely so much space that the outer structural shape does not substantially differ from a conventional comparative type of a plug-in socket without voltage conversion.

Preferably the socket housing of the plug-in socket according to the invention is hermetically sealed and has no additional convection. Hermetic closure and the avoidance of additional convection phenomena is a further prerequisite for shifting the safety requirements from the terminal device into the plug-in socket according to the invention, and thereby saving on costs. Equally that can facilitate installation of the plug-in socket. Preferably the plug-in socket is fixedly connected to the housing of the terminal device in manufacture of the terminal device.

It is preferred that coupling means for coupling the plug-in socket to the housing of the terminal device are arranged on the socket housing. By virtue of that feature the plug-in socket according to the invention externally is scarcely different from the conventional plug-in sockets without integrated voltage conversion means. Conventional installation methods or installation measures can thus still be applied to the plug-in socket according to the invention. Adaptation of or alteration to the housing of the terminal device is thus scarcely required.

It is particularly preferred if the socket housing according to the invention can be pushed or also plugged into the housing of a terminal device. It is particularly preferred if the plug-in socket is pushed in from the outside of the housing. The socket housing is of a suitable design configuration for that purpose so that it can be pushed in for example until reaching a flange or the like against which the plug-in socket is arrested. That aspect of the invention takes account of a particularly simple structure for the terminal device. The terminal device can be constructed without having to comply with the respective country-specific demands on voltage conversion from a primary voltage (for example mains voltage) into a secondary voltage. It is only when the definitive destination of the terminal device is known that it is fitted with a plug-in socket according to the invention which then precisely complies with the specific technical requirements involved. That avoids the use of external plug mains units, which affords the aforementioned advantages, and at the same time the fixed installation of a mains unit in the terminal device is not required, which would have the disadvantages that have also been referred to hereinbefore. Quite apart from that definitive fitment of the terminal device with a plug-in socket according to the invention, the voltage conversion means can naturally also be designed in such a way that they automatically switch over between various country-specific or use-specific requirements in terms of voltage conversion.

A further preferred embodiment of the plug-in socket provides that the second electrical coupling means, upon being pushed in, plugged in or installed in some other way, fit together directly with the corresponding means for tapping off the secondary voltage or also numerous secondary voltages.

In a preferred configuration of the plug-in socket according to the invention the voltage conversion means are of a miniaturised configuration, the output power being limited at the same time. That limits the emission of heat due to energy losses. At the same time hermetic integration into the socket housing is made possible in the situations in which an excessively high output power could be demanded by the terminal device, without power limitation.

In accordance with a preferred embodiment a safeguard against overloading is integrated into the socket housing. Preferably a fusible insert is used for that purpose. It is to be observed in that respect that the possibility of gaining access to the fusible insert is provided for replacement thereof. That part of the socket housing is then under some circumstances not hermetically sealed. Nonetheless the external structural shape of the plug-in socket remains designed in accordance with the aforementioned advantages upon installation.

It is particularly preferred if the plug-in socket can be coupled to corresponding electrical contact means of standard mains plugs in accordance with the Euro-standard. It is further preferred if the plug-in socket can be coupled to corresponding electrical contact means of standard plugs in accordance with the American standard. Those embodiments are particularly advantageous for the reason that the external contour of the housing portion of the plug, which is to be pushed in, is always substantially the same in accordance with those standards, and it is only the contact elements which are predominantly in the form of contact pins, that are at a differing spacing corresponding to the standards. That permits predictable complication and expenditure in manufacture of the plug-in socket according to the invention.

It is also particularly advantageous if the voltage conversion means for a plug-in socket according to the invention are of a closed, one-piece structural configuration. That permits simplified, less expensive and more reliable assembly of the mains plug. In particular a modular nature for the voltage conversion means provides that the product procedures can be of a more effective nature.

It is further preferred if the voltage conversion means are not only of a compact, closed one-piece structural configuration but also have an arrangement of the electrical contacts which, when stacking a plurality of voltage conversion means of the same structure in the socket housing of the plug-in socket, permits simple—almost automatic—electrical coupling, in particular parallel connection, of the voltage conversion means which are of the same structure, so that the required output power of the plug-in socket is adjustable in stages by electrical coupling of the plurality of voltage conversion means. In that way production procedures can be simplified and plug-in sockets which are externally of the same structure can be provided for different secondary currents. In particular the increase in the output power is facilitated by an advantageous position in respect of the contacts—that is to say the inputs and outputs—of the voltage conversion means, if they are for example all arranged on the same respective and easily accessible side of an externally one-piece voltage converter. In comparison with conventional microelectronic circuits, for example microchips, the invention affords the advantage that the contacts are provided specifically for a given stacking configuration. That is not possible to achieve with conventional integrated circuits.

It is particularly preferred if the plug-in sockets according to the invention, in accordance with one or more of the above-specified preferred embodiments, are used in an electrical terminal device such as for example mains-operated electrical and electronic devices, in particular such electronic devices involving low power, preferably for example devices in consumer electronics or professional audio and video technology. Low power in this respect signifies in particular a connected load of 1000 W or less, preferably between about 20 and 200 W.

In addition plug-in sockets according to the invention are particularly preferred for dissipation power levels of the terminal device of less than 10 W.

The invention is based on the notion of providing a completely novel concept relating to the voltage supply of terminal devices which require the use of mains units for voltage conversion. The required electronics are in that case not only of a particularly small nature but is also disposed in a quite specific component of the terminal devices—more specifically in the plug-in socket, thereby affording amazing advantages. To embody the invention, plug-in sockets are of such a design configuration that the voltage conversion means are integrated therein without the external dimensions being substantially altered in relation to the dimensions of commercially available comparative types. An aspect of the solution according to the invention therefore provides that the electronics necessary for voltage conversion are integrated into the plug-in socket, that is to say in the appropriate location of choice for installation. Furthermore the electronics are so miniaturised that they can be integrated in the device connection socket. A plug-in socket which is prepared in that way has a commercially available plug connection on the primary side (outside of the device). On the secondary side (inside of the device) the plug-in socket according to the invention has second electrical coupling means at which the terminal device can take off the desired secondary voltage. Those second electrical coupling means can also be standard plug connectors. That therefore affords the amazing advantage that on the one hand it is possible to dispense with external plug mains units but nonetheless the safety and approval requirements, for example in accordance with mains voltages of various countries, are involved not in the terminal device itself but in the plug-in socket. That is simply finally plugged or inserted into the terminal device which in that respect is already in a finished condition in order to comply with the respective electrical specifications.

Two embodiments of the invention are described in greater detail hereinafter with reference to the drawings.

DESCRIPTION OF THE PREFERRED EMBODIMENTS

Figure 1:
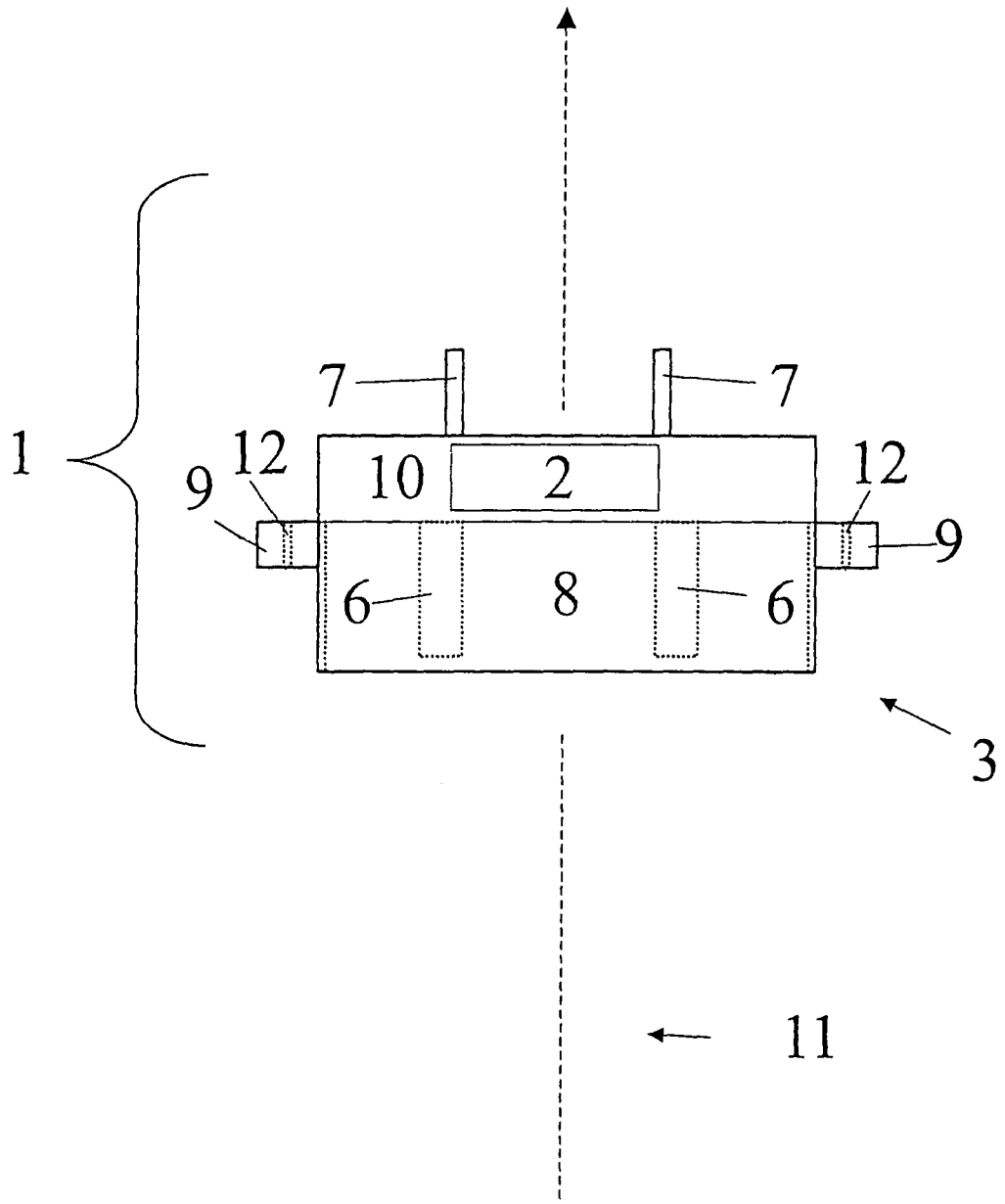
FIG. 1 shows a lateral view in section of a first preferred embodiment of the plug-in socket according to the invention with voltage converter.

FIG. 1 shows an embodiment of a plug-in socket according to the invention. This diagrammatic lateral view in section shows the essential components of the plug-in socket 1 according to the invention. They are the socket housing 1 in which the voltage conversion means 2 are integrated. The first electrical contact means 6 for contacting with the electrical contact means of a corresponding standard plug are in this embodiment enclosed by the socket housing 3. In that respect, provided in the push-in insertion direction 11 is a push-in opening or a push-in chamber 8 into which the corresponding standard plug can be pushed. The second electrical contact means 7 for connection of the secondary voltage within the terminal device project out of the socket housing 3 in this embodiment. However they can equally be angled, bear flat against the socket housing 3 or be integrated therein as long as they are still contactable. Typically, the voltage conversion means 2 are disposed in a rear closure plate 10 of the plug-in socket 1 according to the invention. Equally however they can also be disposed between the second electrical contact means 7 or in another region of the socket housing 3 as long as there is just sufficient space there. For installation in the housing of a terminal device, the socket housing has coupling means 9. Typically they are in the form of a flange which allows insertion into an opening of the terminal device housing only as far as a certain point. Then for example screws or rivets can be passed through the coupling openings 12, with which screws or rivets the plug-in socket 1 is fixedly connected to the housing of the terminal device. Various forms of arresting measures can also be considered as the coupling means 9, 12—such as for example barbs or the like of plastic material which, upon insertion of the plug-in socket according to the invention, latch into the housing of the terminal device. It is also possible to envisage alternatively or additionally glueing the plug-in socket to the housing of the terminal device.

Figure 2:
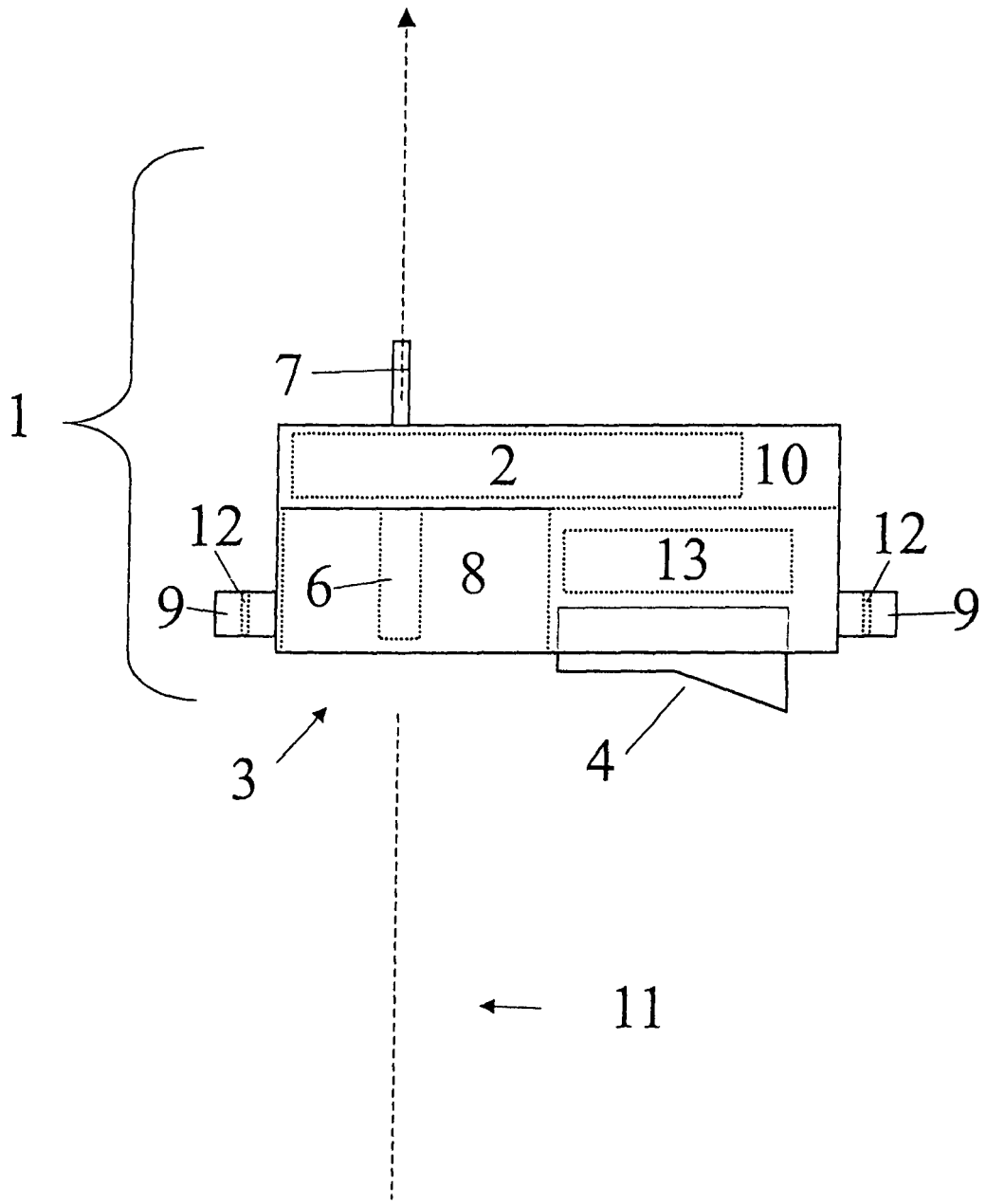
FIG. 2 shows a lateral view in section of a second preferred embodiment of the plug-in socket according to the invention with voltage converter and switch.

FIG. 2 shows a further preferred embodiment of the plug-in socket 1 according to the invention. This plug-in socket 1 differs from the plug-in socket 1 of FIG. 1 in that it additionally has a mains switch 4. The mains switch 4 is also substantially integrated into the socket housing 3. Upon being installed in accordance with the invention in the housing of a terminal device it is disposed on the outside of the device. That makes it possible for the terminal device to be completely separated from the primary voltage. Parasitic losses or losses which are unwanted in other ways and which are caused by only the secondary circuit being interrupted are eliminated thereby. Actual zero consumption is to be attained in that way. Furthermore the plug-in socket according to the invention, in the embodiment of FIG. 2, has an integrated safeguard against overload as indicated at 13. This involves for example a fusible cut-out insert. If a certain level of secondary power is exceeded, the fusible insert is destroyed. It is possible to gain access to the fusible insert for example by way of an opening which is additionally provided for that purpose, as is indicated hereinafter in the embodiments of FIGS. 3 through 5. The voltage conversion means 2 of this embodiment are either equally disposed in a rearwardly arranged board 10 or in another region of the socket housing which provides sufficient space. The foregoing description correspondingly applies to the arrangement of the first electrical contact means 6 and the second electrical contact means 7 as well as the coupling means 9, 12.

It is particularly advantageous if the voltage conversion means 2 are constructed in a compact, one-piece form, as shown here in FIGS. 1 and 2. That facilitates assembly and if required it is also possible for a plurality of those one-part voltage converters 2 to be arranged or stacked in the socket housing 3, whereby the output power of the plug-in socket according to the invention can be increased. Preferably the voltage conversion means 2 are arranged as compactly as possible and centrally in the socket housing 3.

Figure 3:
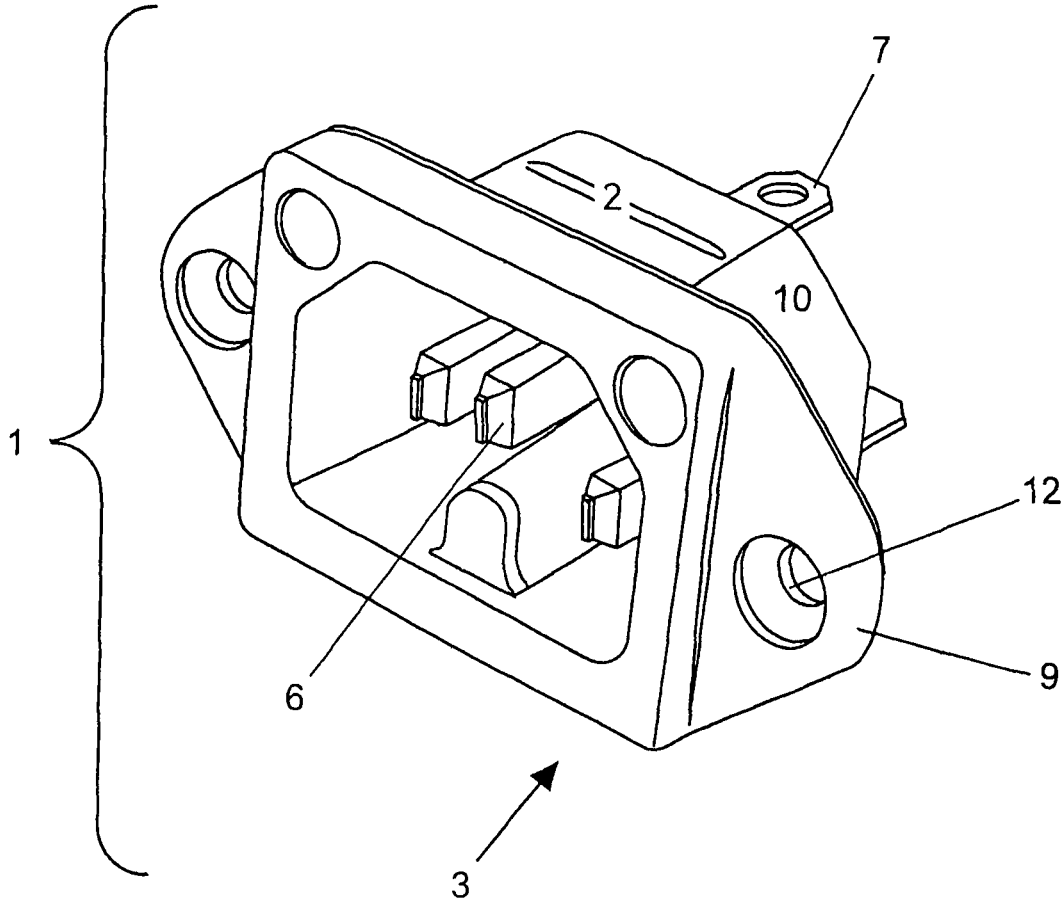
FIG. 3 shows a perspective view of a plug-in socket according to the invention for warm device plugs.

FIG. 3 shows a further embodiment of a plug-in socket according to the invention. In this case the external structure of the socket housing 3 is in the foreground. The illustrated structural form for a hot device plug is practically unchanged externally in relation to a conventional plug-in socket without integrated voltage converter. That makes it possible to use plug-in sockets with voltage converter, in accordance with the invention, instead of the previous commercially available plug-in sockets without a voltage converter.

Figure 4:
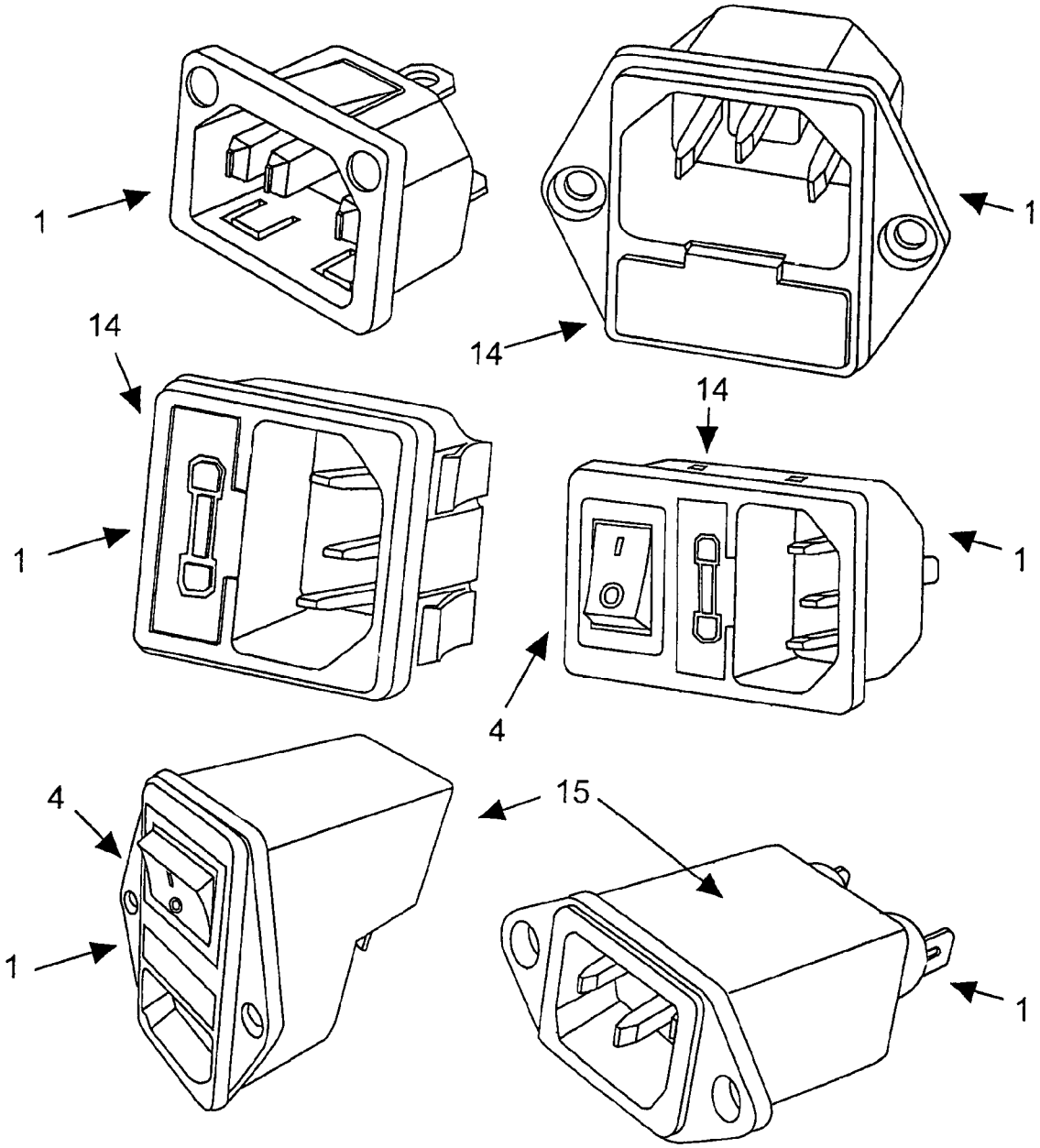
FIG. 4 shows six perspective views of six different plug-in sockets according to the invention for cold device plugs.

FIG. 4 shows further embodiments for plug-in sockets 1 for cold device plugs with and without a switch 4, with and without a fuse box 14 and with and without a filter housing 15. In this case also it is to be noted that the external configuration should not be substantially changed in relation to the conventional plug-in sockets. In particular the plug-in socket 1 according to the invention is so designed that it is compatible with the conventional plug-in sockets. It will be appreciated that that applies in particular in regard to coupleability to the corresponding standard plugs. It can be seen from the embodiments shown in FIG. 4 that the external dimensions change, depending on whether the arrangement has a filter housing 15 or a switch 4 or also a fuse box 14 in the plug-in socket 1. In comparison however, additionally disposing the voltage conversion means 2 in the plug-in socket 1 does not entail any additional variation of substance, in the external dimensions, in comparison with the conventional plug-in socket. The advantages according to the invention are however considerable, as already stated hereinbefore, by virtue of the integration of the voltage conversion means 2 in the plug-in socket.

Figure 5:
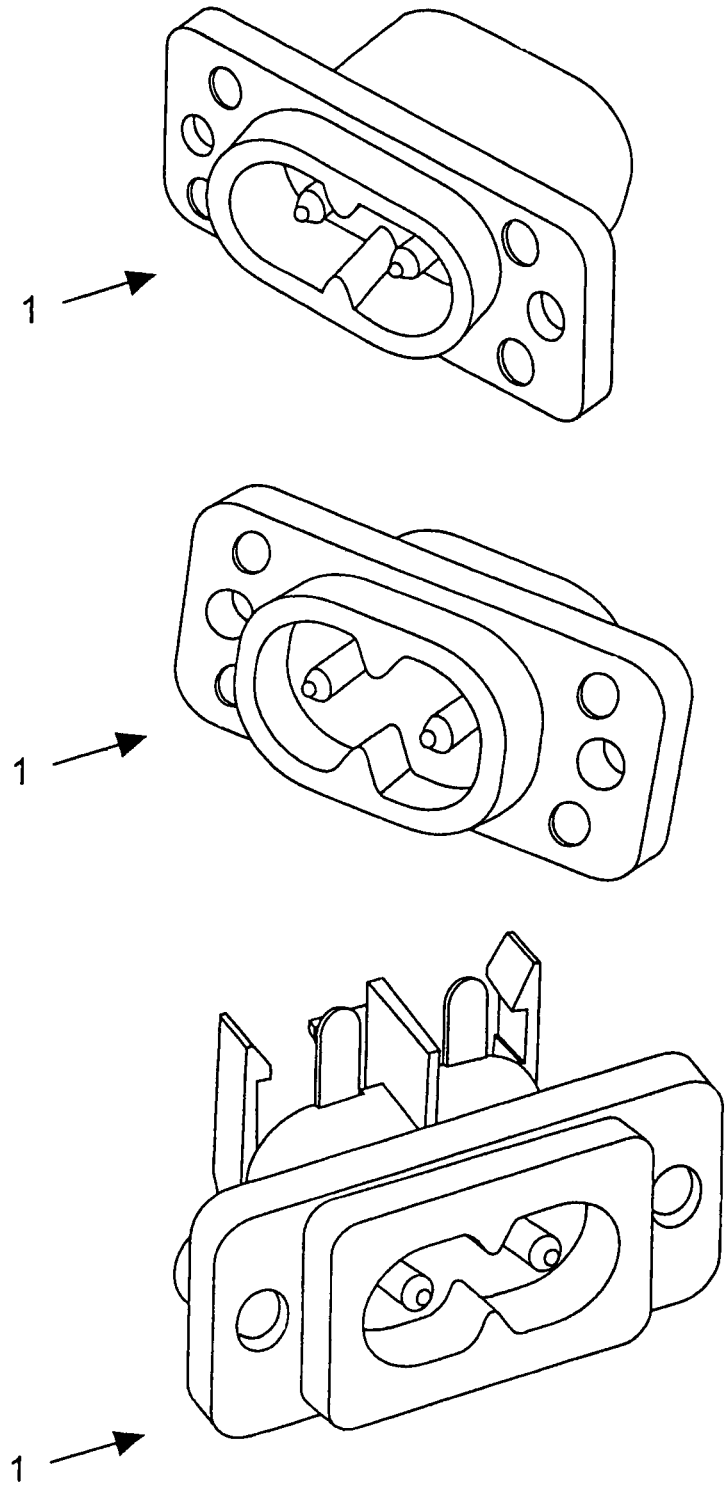
FIG. 5 shows three perspective views of three different installation mini-sockets for razor plugs.

FIG. 5 shows three further perspective views of embodiments of plug-in sockets 1 according to the invention. It is also to be noted here that, in spite of the typically very small external dimensions with this structural form, irrespective of the small size, integration of the voltage conversion means into the plug-in socket does not involve any substantial change in comparison with the conventional structure, at least insofar as there is installation compatibility of the plug-in sockets according to the invention and the conventional plug-in sockets.

In the case of the present invention, the voltage-converting part is provided in the device, that is to say in the specific electrical device, or, in other words, the voltage-converting part is embodied in the load (for each device also consumes energy and is thus also to be referred to as the load) and not for example—as in the case of previously known solutions—in a mains plug or in a wall plug outlet.

The present invention has the particular advantage that an electrical device is supplied with electrical energy by way of the mains voltage which is usual to the country in question, by way of the connection standards which are usual to the country in question (for example standard plug outlets for Europe) and by way of normal cables, but that the ac voltage provided (alternating current) is converted into the operating voltage required—for the device (for the load)—in the load, that is to say in the electrical device. Therefore the present invention does not require either a specific configuration in respect of the wall plug outlet or the specific configuration of a cable or plug.

While the foregoing description and drawings represent the present invention, it will be invention, it will be obvious to those skilled in the art that various changes may be made therein without departing from the true spirit and scope of the present invention.

What is claimed is:

1. A plug-in socket for coupling to a corresponding standard plug and for connection of an electrical terminal device to a primary voltage, comprising:

a socket housing;

a first electrical contact arranged in the socket housing for coupling to an electrical contact of the corresponding standard plug;

a voltage converter integrated in the socket housing and converting a primary voltage into at least one secondary voltage for the electrical terminal device, wherein the primary voltage and the at least one secondary voltage are different, non-zero voltages; and a second electrical contact arranged on the socket housing for electrical contacting of the secondary voltage;

wherein the voltage converter is integrated in the socket housing so that the external dimensions of the socket housing are substantially predetermined by the dimensions of the corresponding standard plug; and wherein a volume of the socket housing is hermetically sealed.

2. The plug-in socket as set forth in claim 1, further comprising:

a mains switch which is also integrated into the socket housing for interrupting a primary circuit;

wherein the external dimensions of the socket housing are substantially predetermined by the dimensions of the corresponding standard plug and the mains switch.

3. The plug-in socket as set forth in claim 1, further comprising:

a filter housing for accommodating electronic filters, the filter housing also integrated into the socket housing;

wherein the external dimensions of the socket housing are substantially predetermined by the dimensions of the corresponding standard plug.

4. The plug-in socket as set forth in claim 1;

wherein the socket housing has no further convection.

5. The plug-in socket as set forth in claim 1;

wherein a coupling device for coupling the plug-in socket to a housing of a terminal device is arranged on the socket housing.

6. The plug-in socket as set forth in claim 1;

wherein the socket housing is of such a configuration that the socket housing can be operationally correctly pushed into a housing of a terminal device, in particular from the outside of a terminal device.

7. The plug-in socket as set forth in claim 1;

wherein the second electrical contact is so designed that the second electrical contact is coupled to a corresponding contact of the terminal device for taking off the secondary voltage when the socket housing is pushed into the terminal device.

8. The plug-in socket as set forth in claim 1;

wherein the voltage converter is of a miniaturised structural form and an output power is limited.

9. The plug-in socket as set forth in claim 1, further comprising:

a safeguard against overload;

wherein the safeguard also integrated into the socket housing, in particular in the form of a fusible insert.

10. The plug-in socket as set forth in claim 1;

wherein the contacts are so designed that the plug-in socket can be coupled to standard plugs in accordance with a Euro-standard.

11. The plug-in socket as set forth in claim 1;

wherein the contacts are so designed that the plug-in socket can be coupled to standard plugs in accordance with an American standard.

12. A voltage converter for the plug-in socket as set forth in claim 1, comprising a closed one-part structural form.

13. The voltage converter as set forth in claim 12, further comprising:

an arrangement of the electrical contacts that, upon stacking of a plurality of structurally identical voltage converters in the socket housing, permits simple electrical coupling, in particular parallel and/or series connection, of the structurally identical voltage converters so that the required output power of the mains plug can be set by electrical coupling of the plurality of voltage converters by increasing the electric current or the electric voltage.

14. An electrical terminal device comprising the plug-in socket set forth in claim 1.

15. The electrical terminal device set forth in claim 14, having a power consumption of less than 10 W.

16. The plug-in socket as set forth in claim 1;

wherein the socket housing is inserted into a housing of the electrical terminal device in such a way that the plug-in socket is fixedly connected to the housing of the electrical terminal device.

17. A plug-in socket that acts to couple a corresponding standard electrical plug to an electrical terminal device, the standard electrical plug providing a non-zero, primary voltage to the plug-in socket, the plug-in socket comprising;

a socket housing;

a first electrical contact arranged inside the socket housing that acts to couple the plug-in socket to the primary voltage provided by an electrical contact of the corresponding standard plug;

a voltage converter integrated in the socket housing that acts to convert the primary voltage into a non-zero, secondary voltage, the secondary voltage being required to operate the electrical terminal device and being less than the primary voltage; and a second electrical contact arranged outside the socket housing that acts to electrically provide the secondary voltage to the electrical terminal device;

wherein the voltage converter is integrated in the socket housing so that the external dimensions of the socket housing are substantially predetermined by the dimensions of the corresponding standard plug; and wherein a volume of the socket housing is hermetically sealed.

18. An electrical terminal device comprising:

a device housing;

a plug-in socket that acts to couple a corresponding standard electrical plug to the electrical terminal device, the standard electrical plug providing a non-zero, primary voltage to the plug-in socket;

wherein the electrical terminal device requires a non-zero, secondary voltage in order to operate, the non-zero, secondary voltage being less than the primary voltage;

wherein the plug-in socket comprises:

a socket housing arranged so as to be located inside the device housing so as to be fixedly connected to the device housing;

a first electrical contact arranged inside the socket housing that acts to couple the plug-in socket to the primary voltage provided by an electrical contact of the corresponding standard plug;

a voltage converter integrated in the socket housing that acts to convert the primary voltage into the secondary voltage; and a second electrical contact arranged outside the socket housing that acts to electrically provide the secondary voltage to the electrical terminal device;

wherein the voltage converter is integrated in the socket housing so that the external dimensions of the socket housing are substantially predetermined by the dimensions of the corresponding standard plug; and wherein a volume of the socket housing is hermetically sealed.

* * * * *